US005908328A

United States Patent [19]

Chen

[11] Patent Number: 5,908,328

[45] Date of Patent: Jun. 1, 1999

[54] BUILDING BLOCK ASSEMBLY

[76] Inventor: Chin-Yi Chen, 56, Minsheng Street, Fengyuan, Taichung Hsien, Taiwan, 420

[21] Appl. No.: 08/990,217

[22] Filed: Dec. 14, 1997

[51] Int. Cl.[6] ..... H01R 3/00

[52] U.S. Cl. ..... 439/500; 439/56; 439/928

[58] Field of Search ..... 439/56, 66, 67, 439/76–7, 99, 100, 178–9, 500, 627, 910, 928; 362/226, 238, 84; 40/552

[56] References Cited

U.S. PATENT DOCUMENTS

| | | | |
|---|---|---|---|
| 3,560,910 | 2/1971 | Sosinski | 439/724 |
| 3,605,076 | 9/1971 | Dozier | 439/589 |
| 5,722,760 | 3/1998 | Chien | 362/84 |

*Primary Examiner*—Lincoln Donovan

[57] ABSTRACT

A building block assembly has a base plate, a battery carrier disposed on the base plate, a plurality of transparent blocks disposed on the base plate, and a plurality of bulb seats disposed in the respective transparent blocks. Each of the bulb seats receives a bulb.

1 Claim, 9 Drawing Sheets

BUILDING BLOCK ASSEMBLY

BACKGROUND OF THE INVENTION

This invention relates to a building block assembly, and more particularly to a building block assembly which has a bulb in each transparent block.

Conventional building blocks do not have any bulb therein. A conventional building block assembly has one or more bulbs disposed on the conventional building block assembly. However, each block does not have a bulb therein. Therefore, the user cannot assemble the blocks in the predetermined positions in order to illuminate the bulbs.

SUMMARY OF THE INVENTION

An object of this invention is to provide a building block assembly which has a bulb in each transparent block to illuminate the building block assembly.

DETAILED DESCRIPTION OF THE INVENTION

Figure 1:
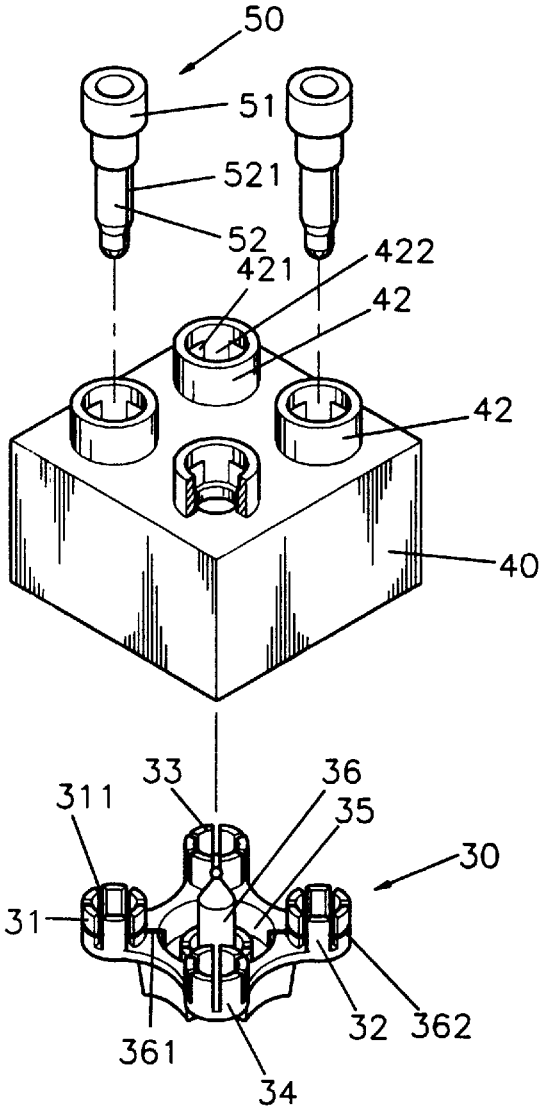
FIG. 1 is a perspective exploded view of two electrically conductive posts, a transparent block, and a bulb seat of preferred embodiment.
Figure 2:
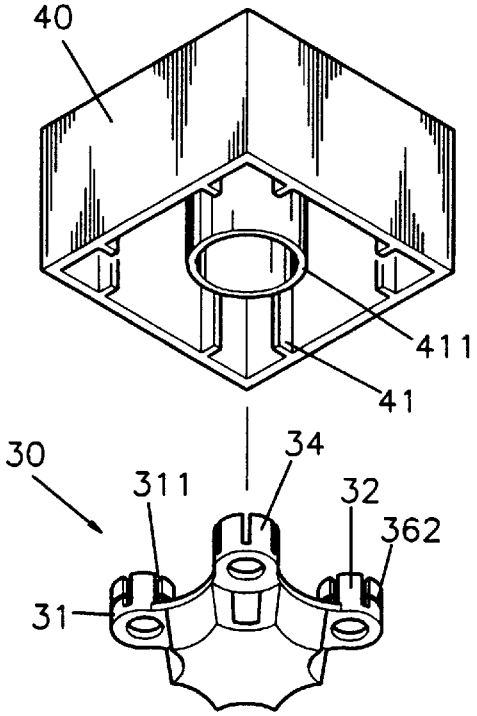
FIG. 2 is a perspective exploded view of a bulb seat and a transparent block of a preferred embodiment.
Figure 3:
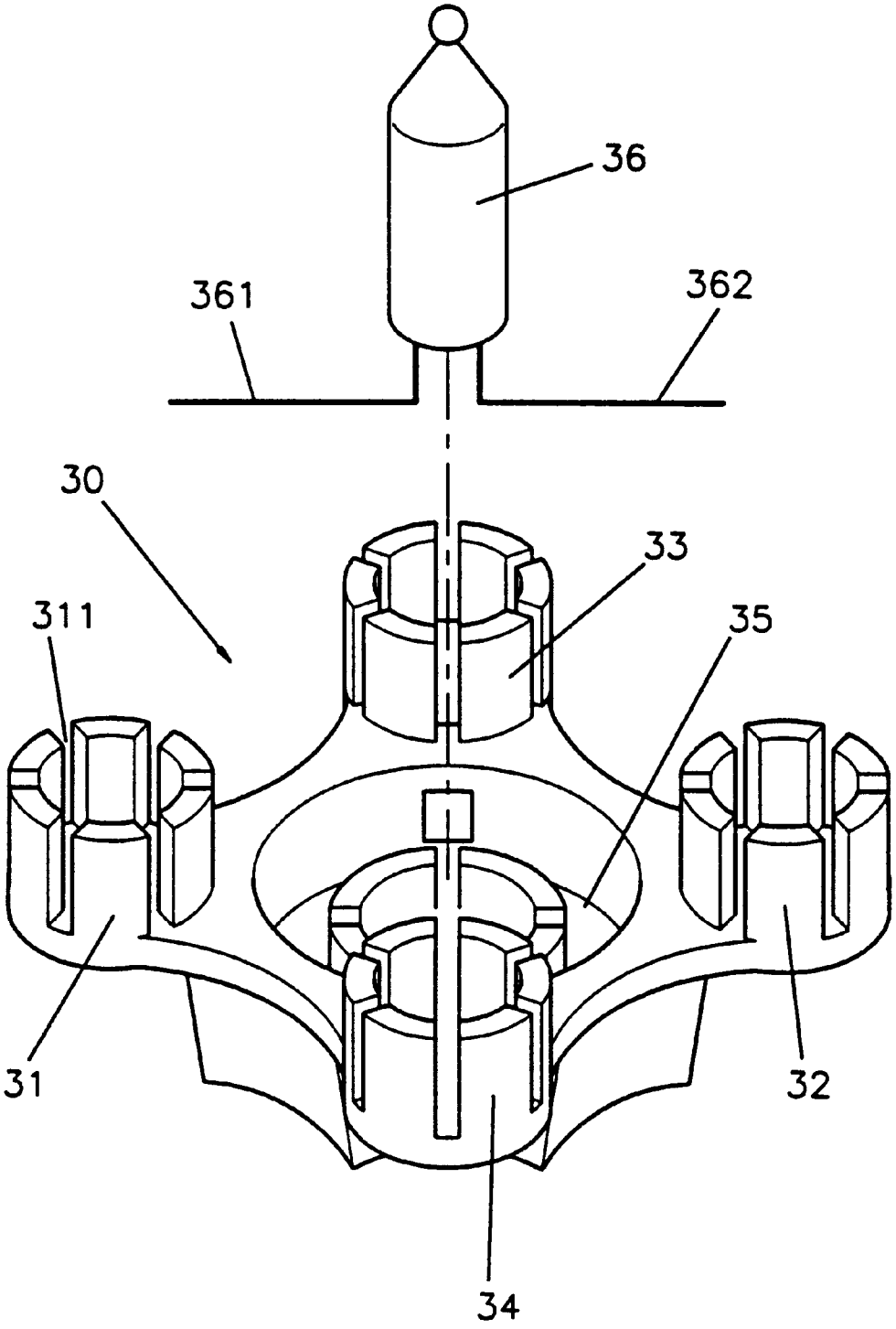
FIG. 3 is a perspective exploded view of a bulb and a bulb seat of a preferred embodiment.
Figure 4:
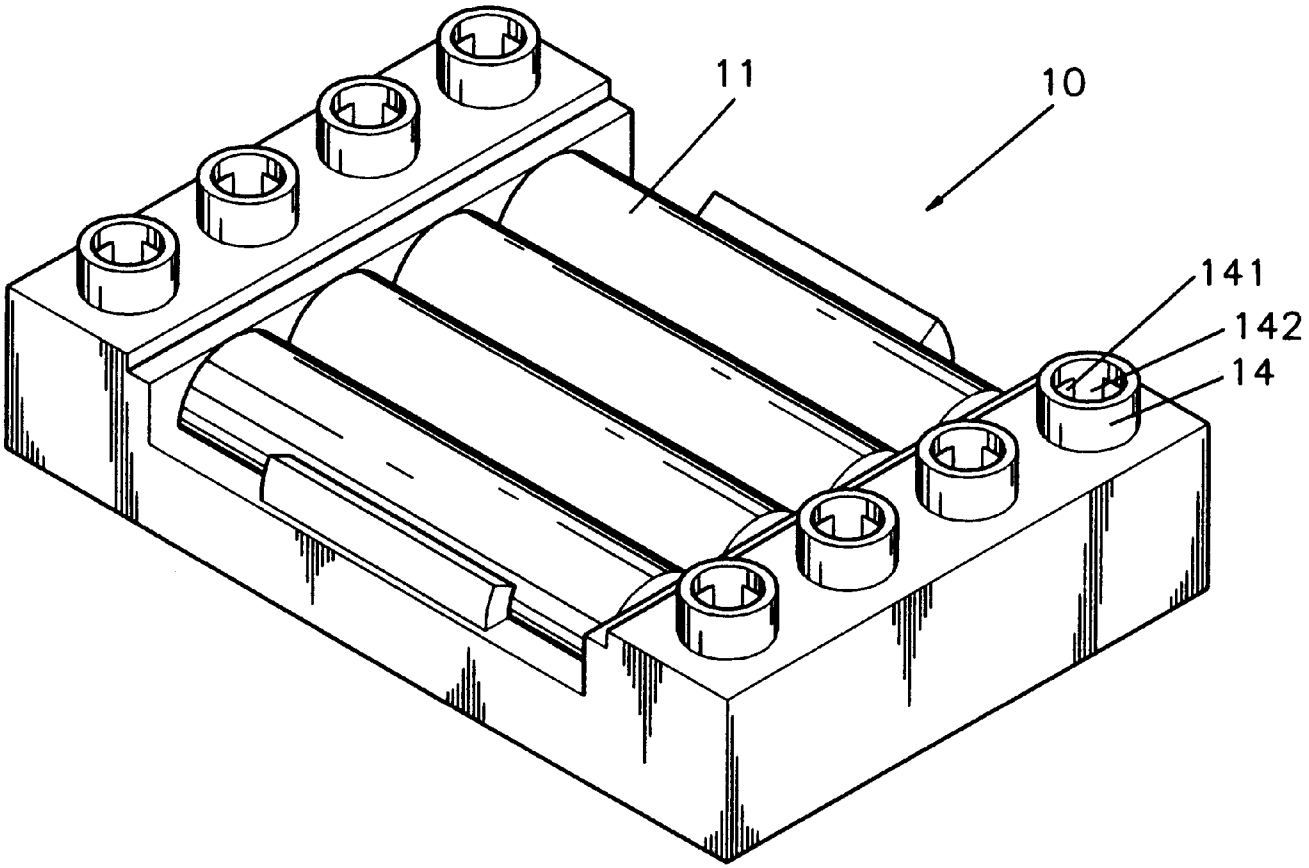
FIG. 4 a perspective view of a battery carrier and a plurality of cells of a preferred embodiment.
Figure 5:
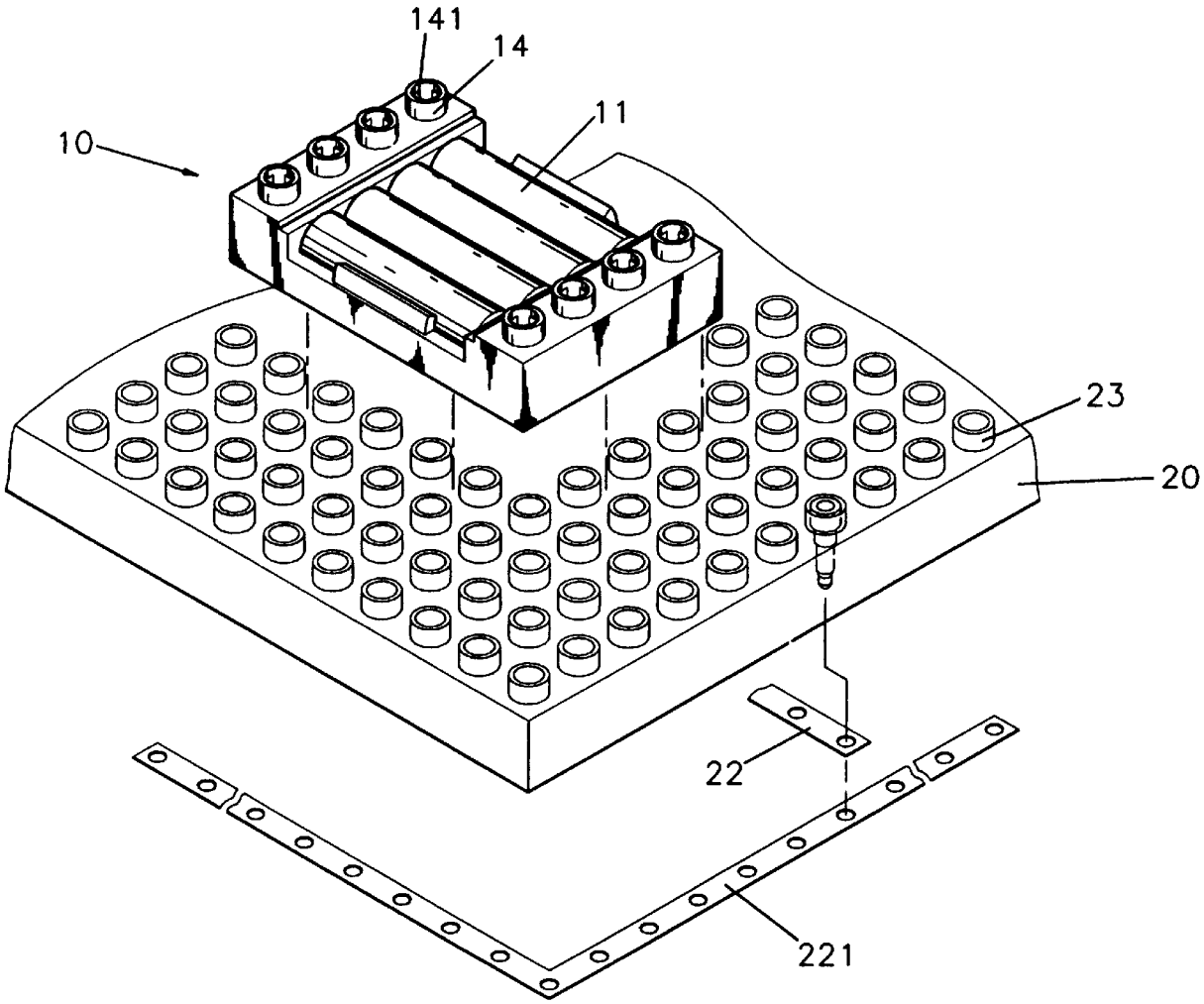
FIG. 5 perspective exploded view of a base plate, a battery carrier, and a plurality of conductive bars.
Figure 6:
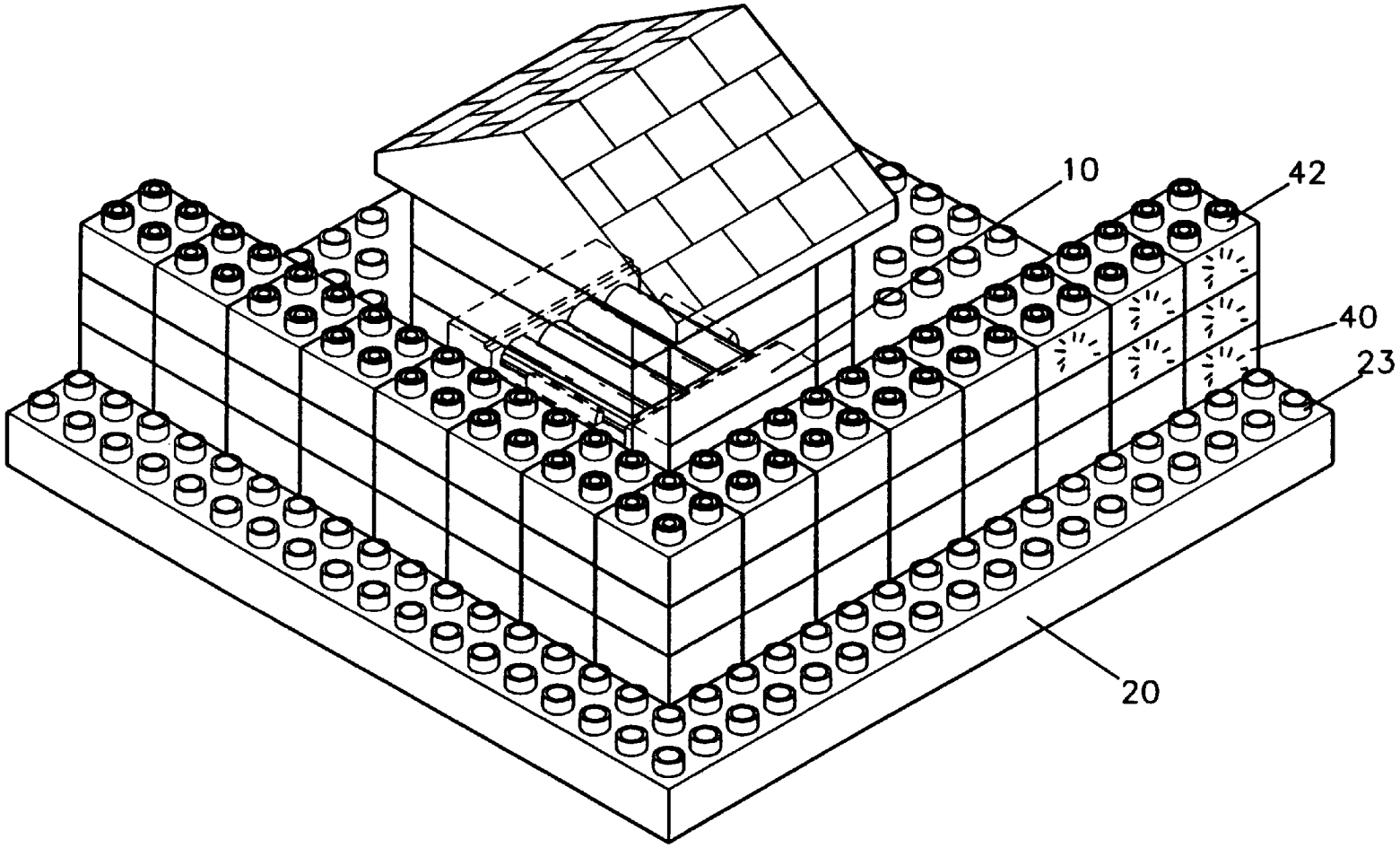
FIG. 6 is a perspective assembly view of a building block assembly of a preferred embodiment in accordance with this invention.
Figure 7:
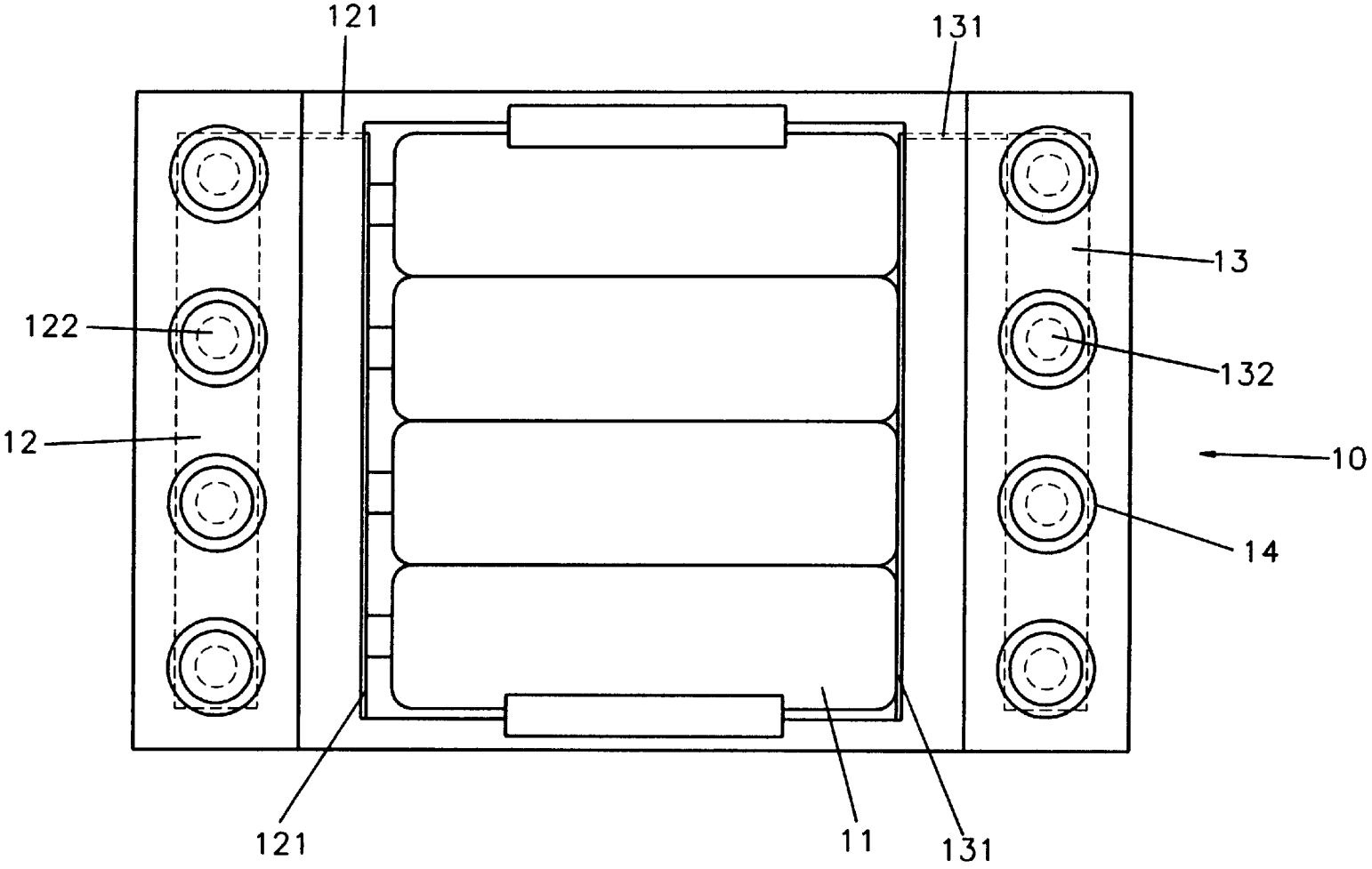
FIG. 7 is an elevational view of FIG. 4.
Figure 8:
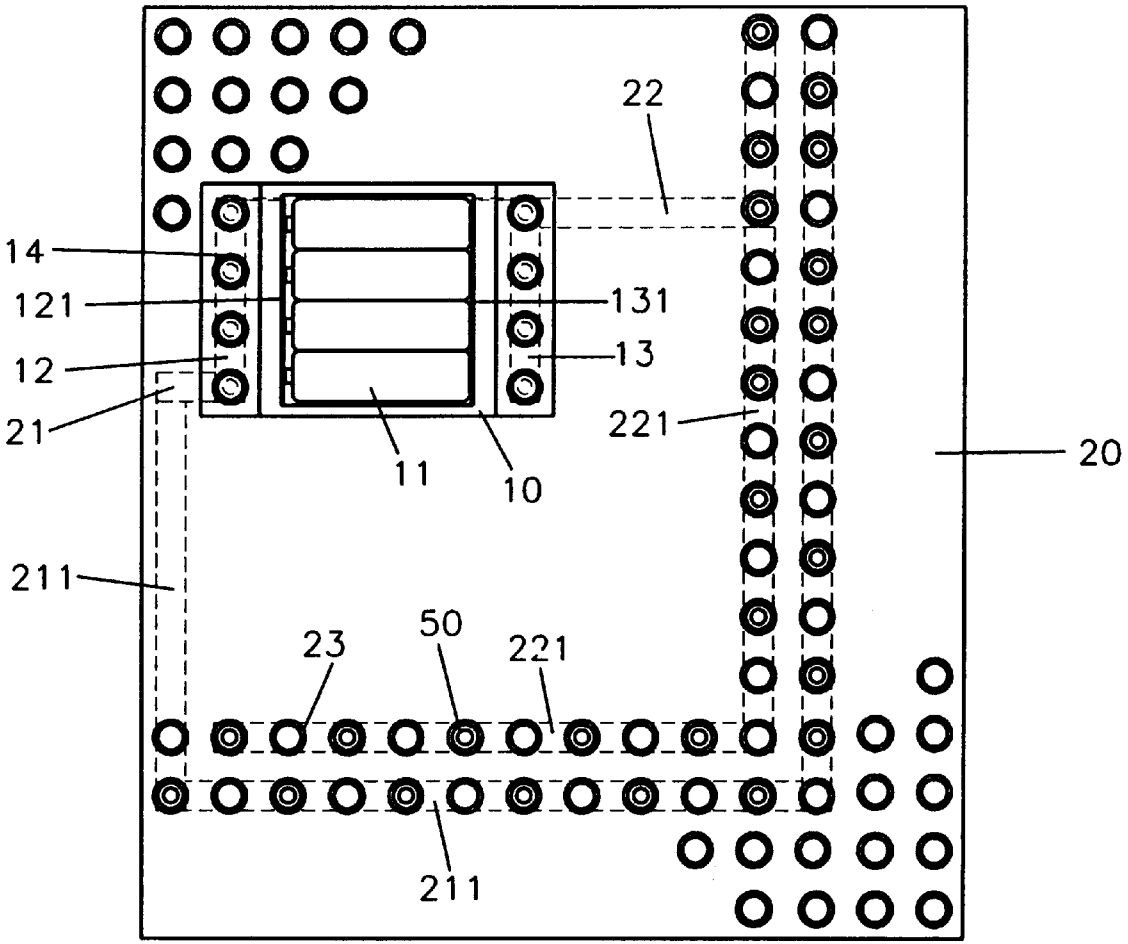
FIG. 8 an elevational view of a base plate.
Figure 9:
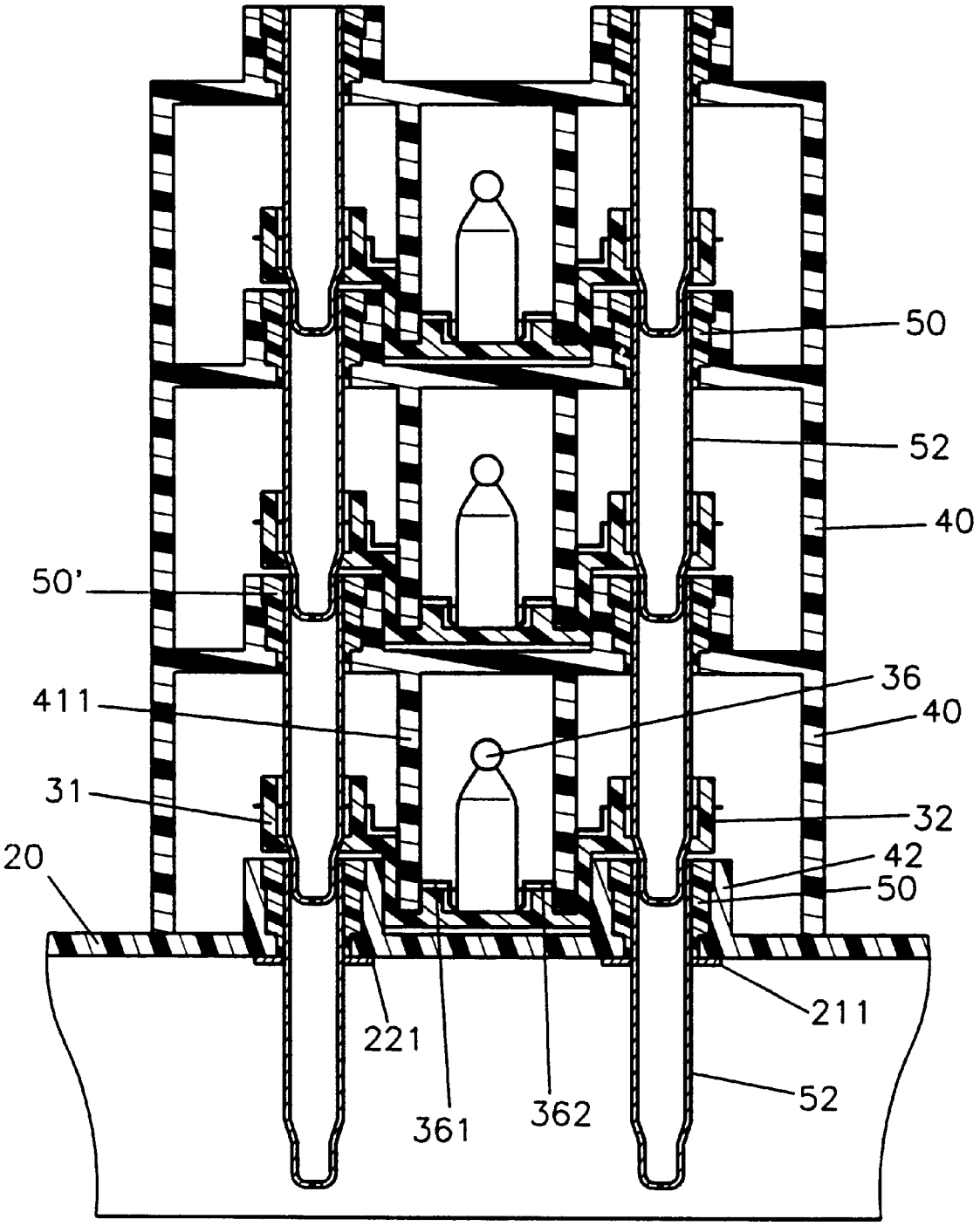
FIG. 9 is a sectional view of a base plate and a plurality of transparent blocks.
Figure 10:
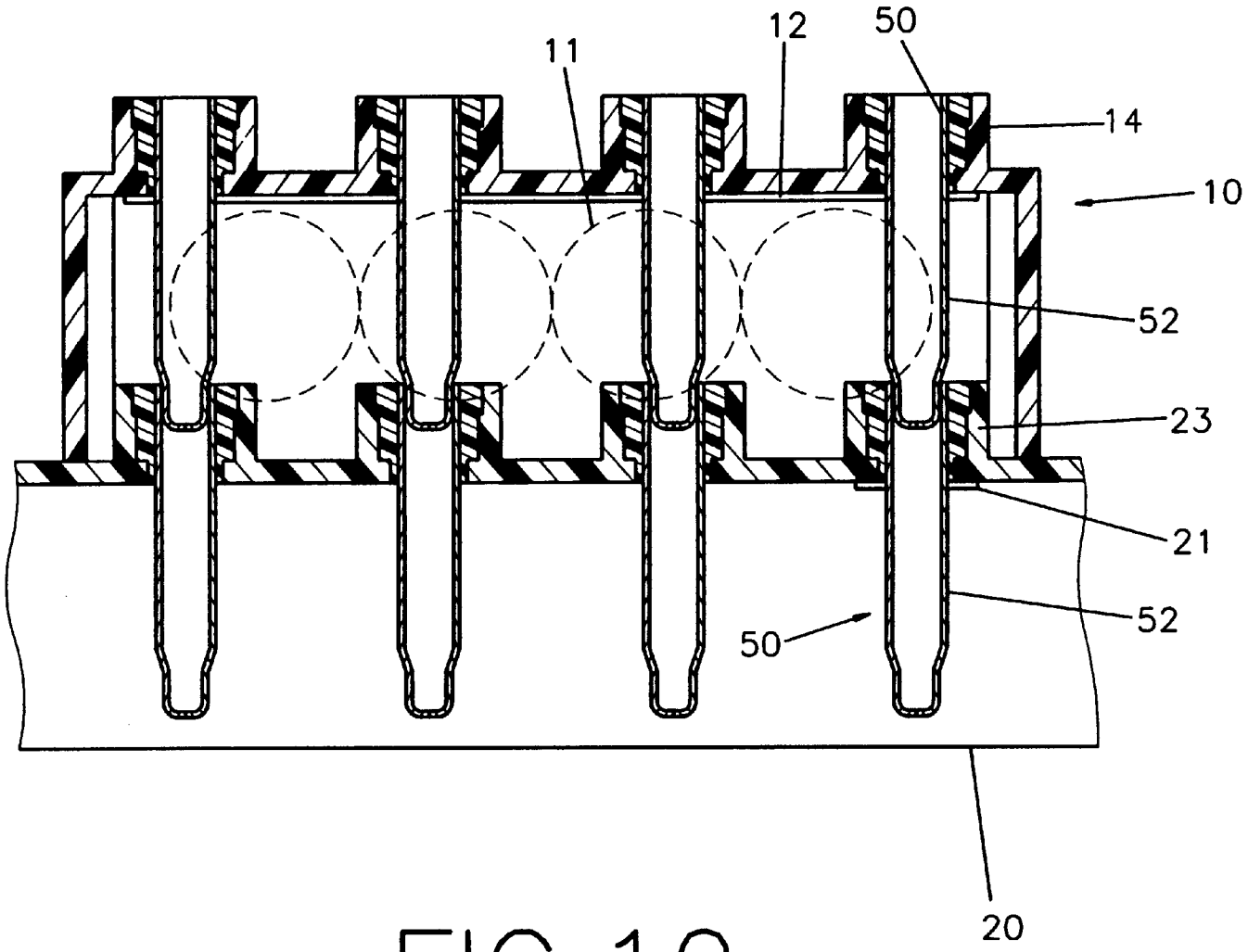
FIG. 10 sectional view of a base plate and a battery carrier.

Referring to FIGS. 1 to 10, a building block assembly comprises a base plate 20, a battery carrier 10 disposed on the base plate 20, a plurality of transparent blocks 40 disposed on the base plate 20, and a plurality of bulb seats 30 disposed in the respective transparent blocks 40. Each of the bulb seats 30 receives a bulb 36. Each of the transparent blocks 40 has a sleeve 411 and a plurality of reinforced bars 41 in an inner periphery of each of the transparent blocks 40. Four annular protruded sockets 42 are disposed on a top portion of each of the transparent block 40. Each of the protruded sockets 42 has a plurality of protruded bars 421 and a through hole 422 receiving an electrically conductive post 50. The electrically conductive post 50 has a hoop 51 enclosing a top portion of the electrically conductive post 50, a copper rod 52 disposed on a bottom of the electrically conductive post 50, and a groove 521 formed on the copper rod 52. Each of the bulb seats 30 has four protruded annular flanges 31, 32, 33, 34, and a center recess 35. Each of the protruded annular flanges 31, 32, 33, 34 has a plurality of spacings 311. The sleeve 411 is inserted in the center recess 35. The bulb 36 has a first copper lead 361 winding the first protruded annular flange 31 and a second copper lead 362 winding the second protruded annular flange 32. A plurality of cells 11 are disposed in the battery carrier 10. The battery carrier 10 has a plurality of collars 14. Each of the collars 14 has a center hole 142, a plurality of protruded plates 141, a first L-shaped copper plate 121 connected to a first conductive plate 12, a second L-shaped copper plate 131 connected to a second conductive plate 13, the first conductive plate 12 having a plurality of round holes 122 matching the respective collars 14, and the second conductive plate 13 having a plurality of circular holes 132 matching the respective collars 14. The base plate 20 has a first conductive bar 22, a second conductive bar 221 connected to the first conductive bar 22, a third conductive bar 21, and a fourth conductive bar 211 connected to the third conductive bar 21. The first conductive bar 22 is placed under an end of the second conductive plate 13. The third conductive bar 21 is placed under an end of the first conductive plate 12.

Each of the protruded annular flanges 31, 32, 33, 34 matches and is inserted in the respective annular protruded sockets 42. The copper rod 52 is inserted in the respective protruded annular flange.

The annular sockets 42 of the first transparent block 40 are confined by the reinforced bars 41 of the second transparent block 40.

I claim:

1. A building block assembly comprises:

a base plate, a battery carrier disposed on the base plate, a plurality of transparent blocks disposed on the base plate, a plurality of bulb seats disposed in the respective transparent blocks, each of the bulb seats receiving a bulb, each of the transparent blocks having a sleeve and a plurality of reinforced bars in an inner periphery of each of the transparent block, four annular protruded sockets disposed on a top portion of each of the transparent blocks, each of the protruded sockets having a plurality of protruded bars and a through hole receiving an electrically conductive post, the electrically conductive post having a hoop enclosing a top portion of the electrically conductive post, a copper rod disposed on a bottom of the electrically conductive post, and a groove formed on the copper rod, each of the bulb seats having four protruded annular flanges, and a center recess, each of the protruded annular flanges having a plurality of spacings, the sleeve inserted in the center recess, the bulb having a first copper lead winding the first protruded annular flange and a second copper lead winding the second protruded annular flange, a plurality of cells disposed in the battery carrier, the battery carrier having a plurality of collars, each of the collars having a center hole, a plurality of protruded plates, a first L-shaped copper plate connected to a first conductive plate, a second L-shaped copper plate connected to a second conductive plate, the first conductive plate having a plurality of round holes matching the respective collars, and the second conductive plate having a plurality of circular holes matching the respective collars, the base plate having a first conductive bar, a second conductive bar connected to the first conductive bar, a third conductive bar, and a fourth conductive bar connected to the third conductive bar, the first conductive bar placed under an end of the second conductive plate, and the third conductive bar placed under an end of the first conductive plate.

* * * * *